US009159512B2

(12) United States Patent
Kodama et al.

(10) Patent No.: US 9,159,512 B2
(45) Date of Patent: Oct. 13, 2015

(54) ELECTROMAGNETIC OPENING/CLOSING DEVICE

(75) Inventors: Kazuhiro Kodama, Hokkaido (JP); Takeshi Okada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/002,651

(22) PCT Filed: Mar. 7, 2012

(86) PCT No.: PCT/JP2012/055789

§ 371 (c)(1),
(2), (4) Date: Aug. 30, 2013

(87) PCT Pub. No.: WO2012/128038

PCT Pub. Date: Sep. 27, 2012

(65) Prior Publication Data

US 2013/0335174 A1 Dec. 19, 2013

(30) Foreign Application Priority Data

Mar. 22, 2011 (JP) ..... 2011-063235

(51) Int. Cl.
*H01H 50/54* (2006.01)
*H01H 47/00* (2006.01)
(Continued)

(52) U.S. Cl.
CPC ..... *H01H 47/002* (2013.01); *H01H 50/541* (2013.01); *H01H 1/0015* (2013.01); *H01H 9/0066* (2013.01); *H01H 36/0046* (2013.01); *H01H 50/545* (2013.01)

(58) Field of Classification Search
CPC ... H01H 1/0015; H01H 47/002; H01H 36/00; H01H 63/36; H01H 71/46; H01H 71/04; H01H 2071/044; G01R 31/3274; G01R 31/327; G01R 31/3275; H02H 3/044
USPC ..... 335/2
See application file for complete search history.

(56) References Cited

U.S. PATENT DOCUMENTS 4,479,117 A * 10/1984 Marquardt ..... 340/644
6,380,499 B1 * 4/2002 Edwards ..... 200/84 C
(Continued)

FOREIGN PATENT DOCUMENTS

JP 03-117318 A 5/1991
JP 03-149722 A 6/1991
(Continued)

OTHER PUBLICATIONS

International Search Report issued in PCT/JP2012/055789 with Date of mailing May 15, 2012.

*Primary Examiner* — Shawki S Ismail
*Assistant Examiner* — Lisa N Homza
(74) *Attorney, Agent, or Firm* — McDermott Will & Emery LLP

(57) ABSTRACT

An electromagnetic opening/closing device A1 includes a detector 5 for detecting an opened or closed state of a contact unit 1; a malfunction determination unit 6 configured to determine presence or absence of malfunction based on the opened or closed state of the contact unit 1 detected through the detector 5 and an opened or closed state of the contact unit 1 corresponding to an exterior command; and an output unit 8 configured to supply an exterior with a determination result by the malfunction determination unit 6.

13 Claims, 9 Drawing Sheets

(51) Int. Cl.

| | |
|---|---|
| *H01H 1/00* | (2006.01) |
| *H01H 9/00* | (2006.01) |
| *H01H 36/00* | (2006.01) |

(56) References Cited

U.S. PATENT DOCUMENTS

| | | | | |
|---|---|---|---|---|
| 6,943,654 | B2 * | 9/2005 | Zhou et al. | 335/106 |
| 7,479,858 | B1 * | 1/2009 | Baurand et al. | 335/132 |
| 7,692,522 | B2 * | 4/2010 | Hartinger et al. | 335/131 |
| 8,138,440 | B2 * | 3/2012 | Onufriyenko et al. | 218/154 |
| 2004/0090292 | A1 * | 5/2004 | Okano et al. | 335/2 |
| 2012/0019340 | A1 * | 1/2012 | Ramezanian et al. | 335/2 |
| 2012/0139670 | A1 * | 6/2012 | Yamagata et al. | 335/2 |
| 2013/0335176 | A1 * | 12/2013 | Lee | 335/187 |

FOREIGN PATENT DOCUMENTS

| | | | |
|---|---|---|---|
| JP | 4-183221 | A | 6/1992 |
| JP | 2001-332160 | A | 11/2001 |
| JP | 2004-186052 | A | 7/2004 |
| JP | 2009-230921 | A | 10/2009 |

* cited by examiner

ELECTROMAGNETIC OPENING/CLOSING DEVICE

RELATED APPLICATIONS

This application is the U.S. National Phase under 35 U.S.C. §371 of International Application No. PCT/JP2012/055789, filed on Mar. 7, 2012, which in turn claims the benefit of Japanese Application No. 2011-063235, filed on Mar. 22, 2011, the disclosures of which are incorporated by reference herein.

TECHNICAL FIELD

The invention relates to an electromagnetic opening/closing device such as an electromagnetic relay or the like.

BACKGROUND ART

For example, Japanese Patent Application Publication No. 2009-230921 (hereafter called "Document 1") discloses an electromagnetic opening/closing device as a prior art. In the device described in Document 1, a relay unit (an electromagnetic relay) is put in a case made from synthetic resin, and a pair of main terminals and a pair of coil terminals are protruded from the case. The pair of main terminals is connected to contacts of the relay unit, and the pair of coil terminals is connected to a coil for an electromagnet of the relay unit. In addition, the pair of main terminals is connected to a power supply line from a power supply to a load(s). The relay unit (the electromagnetic opening/closing device) is turned on when an excitation current flows between the pair of coil terminals, while the relay unit (the device) is turned off when no excitation current flows between the pair of coil terminals. That is, the electromagnetic opening/closing device is turned on, thereby closing the power supply line from the power supply to the load, while the device is turned off, thereby opening the power supply line.

In such electromagnetic opening/closing devices, the conduction between contacts (a stationary contact and a moving contact) may be impaired due to surface oxidation thereof, or the stationary contact and the moving contact may be welded to each other due to arc. Conventionally, apparatuses equipped with such an electromagnetic opening/closing device require to detect various malfunction generated in the device.

SUMMARY OF THE INVENTION

The present invention has been achieved in view of the above circumstances, and an object thereof is to perform self-checking on the presence or absence of malfunction to give a notification to an exterior.

The present invention is an electromagnetic opening/closing device that comprises a stationary contact (10) and a moving contact (11), and is configured to open or close the stationary contact (10) and the moving contact (11) in accordance with an exterior command for opening or closing the stationary contact (10) and the moving contact (11). The electromagnetic opening/closing device comprises a detector (5), a determination unit (6) and an output unit (8). The detector (5) is configured to detect an opened or closed state of the stationary contact (10) and the moving contact (11). The determination unit (6) is configured to determine presence or absence of malfunction (of the stationary contact and the moving contact) based on the opened or closed state of the stationary contact (10) and the moving contact (11) detected through the detector (5) and an opened or closed state of the stationary contact (10) and the moving contact (11) corresponding to the exterior command. The output unit (8) is configured to supply an exterior with a determination result by the determination unit (6).

In an embodiment, the determination unit (6) is configured to determine that closing malfunction occurs between the stationary contact (10) and the moving contact (11) if a state of the stationary contact (10) and the moving contact (11) detected through the detector is the opened state when the exterior command is a close control signal for closing the stationary contact (10) and the moving contact (11).

In an embodiment, the determination unit (6) is configured to determine that opening malfunction occurs between the stationary contact (10) and the moving contact (11) if a state of the stationary contact (10) and the moving contact (11) detected through the detector is the closed state when the exterior command is an open control signal for opening the stationary contact (10) and the moving contact (11).

In an embodiment, the output unit (8) is configured to output a signal as the determination result indicating a type of the malfunction.

In an embodiment, the electromagnetic opening/closing device further comprises auxiliary contacts linked with opening or closing of the stationary contact (10) and the moving contact (11). The detector is configured to detect the opened or closed state of the stationary contact (10) and the moving contact (11) based on an opened or closed state of the auxiliary contacts.

In an embodiment, the device further comprises an electromagnet (20, 22) configured to allow the moving contact (11) to come into contact with or separate from the stationary contact (10) by electromagnetic force. The detector (5) comprises a detection coil (53) configured to have impedance varying in response to excitation of the electromagnet (20, 22). The detector is configured to detect opening or closing of the stationary contact (10) and the moving contact (11) based on a change in the impedance of the detection coil (53).

In an embodiment, the electromagnetic opening/closing device comprises a drive unit (2) configured to move the moving contact (11). The detector (5) is configured to detect the opened or closed state of the stationary contact (10) and the moving contact (11) based on a movement of the moving contact (11) through the drive unit (2).

In an embodiment, the detector (5) is configured to detect the opened or closed state of the stationary contact (10) and the moving contact (11) based on a voltage applied across the stationary contact (10) and the moving contact (11).

The electromagnetic opening/closing device of the present invention can perform self-checking on the presence or absence of malfunction to give a notification to the exterior.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

Embodiment 1

Figure 1:
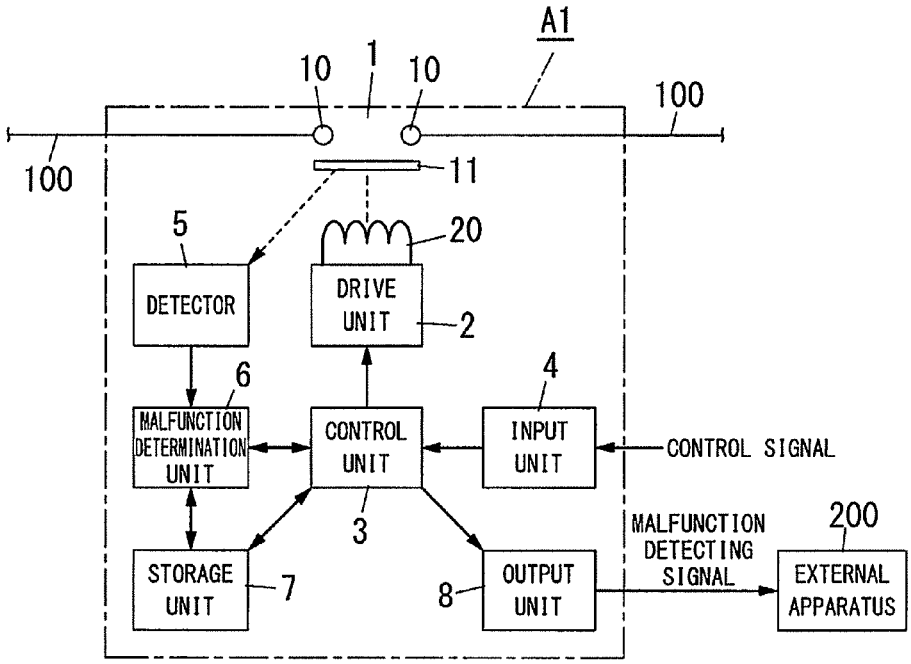
FIG. 1 is a block diagram of an electromagnetic opening/closing device in accordance with an embodiment 1 of the present invention.

FIG. 1 shows an electromagnetic opening/closing device A1 in accordance with an embodiment 1 of the present invention. The electromagnetic opening/closing device A1 includes at least one stationary contact 10 and a moving contact 11, and is configured to open or close the stationary contact 10 and the moving contact 11 in accordance with an exterior command for opening or closing the stationary contact 10 and the moving contact 11. In the example of FIG. 1, the electromagnetic opening/closing device A1 includes a contact unit 1, a drive unit 2, a control unit 3, an input unit 4, a detector 5, a malfunction determination unit 6, a storage unit 7, an output unit 8 and the like. The contact unit 1 has two stationary contacts 10 inserted along an electrical circuit 100 and a moving contact (a mover) 11 configured to come into contact with or separate from the stationary contacts 10. That is, the contact unit 1 is closed and the electrical circuit 100 is in a conducting state when the moving contact 11 is in contact with the stationary contacts 10, and the contact unit 1 is opened and the electrical circuit 100 is in a non-conducting state when the moving contact 11 is out of contact with the stationary contacts 10.

Figure 2:
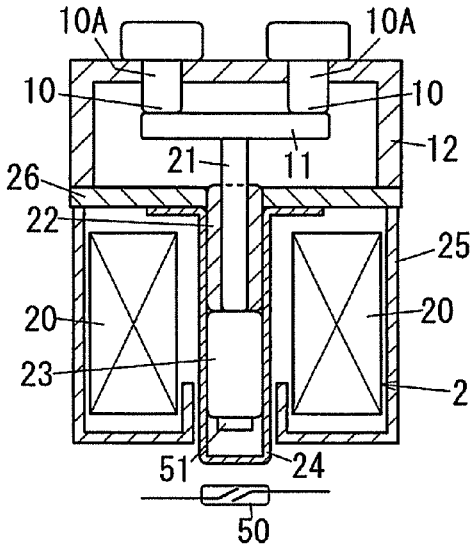
FIG. 2 is a sectional view of the electromagnetic opening/closing device.

FIG. 2 shows a sectional view of the electromagnetic opening/closing device A1 with part thereof omitted. The moving contact 11 is shaped like a rectangular flat plate made of copper or copper alloy, of which a central part in a length direction (in FIG. 2, a horizontal direction) is supported by a movable shaft 21 so that the contact 11 is free to move in a first direction (in FIG. 2, a vertical direction). Hereinafter, a first side of the first direction is also called an upper side, and a second side of the first direction is also called a lower side. The stationary contacts 10 are disposed on the tips of stationary terminals 10A shaped like a cylinder (end faces (lower ends) on the second side in the first direction). The stationary contacts 10 and the moving contact 11 are put in a ceramic sealing container 12 shaped like a case with an opening on the second side of the first direction (the lower side). The pair of stationary terminals 10A penetrates a bottom wall of the sealing container 12.

The drive unit 2 is formed of an excitation coil 20, the movable shaft 21, a stationary core 22, a movable core 23, a cap 24, yokes 25, 26 and the like. The cap 24 is formed of nonmagnetic material in the shape of a circular tube with a bottom. The movable core 23 is put in the cap 24 on a bottom side thereof (the second side of the first direction), while the stationary core 22 is put in the cap 24 on an opening side thereof (the first side of the first direction) and the stationary core 22 is fixed to the cap 24. The movable shaft 21 penetrates a hollow space of the stationary core 22 so that it is free to move in the hollow space. The movable core 23 is fixed to an end (a lower part) of the movable shaft 21 on the second side of the first direction. A return spring (not illustrated) is arranged between the stationary core 22 and the movable core 23 in order to elastically bias the movable core 23 in a direction separated from the stationary core 22 (toward the second side of the first direction). In addition, a contact pressure spring (not shown) is arranged between the stationary core 22 and the moving contact 11 in order to elastically bias the moving contact 11 in a direction approached to the stationary contacts 10 (toward the first side of the first direction). A coil bobbin (not shown) made from insulating material is disposed outside the cap 24, and the excitation coil 20 is wound around the coil bobbin. The yokes 25, 26 are disposed outside the excitation coil 20. The excitation coil 20 and the yokes 25, 26 constitute a magnetic circuit. The yoke 26 is shaped like a flat plate, and is arranged between the excitation coil 20 and the sealing container 12.

When no excitation current flows through the excitation coil 20, the movable core 23 is elastically biased with the return spring to move toward the second side of the first direction (downward) and thereby the movable shaft 21 and the moving contact 11 move toward the second side of the first direction (downward) as well. As a result, the moving contact 11 is separated from the stationary contacts 10 and the contact unit 1 is opened. On the other hand, when an excitation current flows through the excitation coil 20, the movable core 23 moves in the direction approached to the stationary core 22 (toward the first side of the first direction) by electromagnetic force acting between the stationary core 22 and the movable core 23. The movable shaft 21 and the moving contact 11 accordingly move toward the first side of the first direction (upward) as well. As a result, the moving contact 11 comes into contact with the stationary contacts 10, and the contact unit 1 is closed. That is, the excitation coil 20 and the stationary core 22 constitute an electromagnet, and the movable core 23 is moved by the electromagnetic force from the electromagnet.

The control unit 3 is configured to control the drive unit 2 in accordance with a control signal (an exterior command) input from an exterior to the input unit 4. That is, the control unit 3 supplies an excitation current to the excitation coil 20 of the drive unit 2 to close the contact unit 1 if the input unit 4 receives a close (ON) control signal for closing the stationary contacts 10 and the moving contact 11, and also stops supplying the excitation current to the excitation coil 20 to open the contact unit 1 if the input unit 4 receives an open (OFF) control signal for opening the stationary contacts 10 and the moving contact 11. The control signal is a DC voltage signal of which level varies between HIGH and LOW. The high level signal is the close (ON) control signal, and the low level signal is the open (OFF) control signal (see FIGS. 3A to 3C).

The detector 5 is configured to detect an opened or closed state of the stationary contacts 10 and the moving contact 11

(the contact unit 1). In the embodiment, the electromagnetic opening/closing device A1 includes auxiliary contacts 50 configured to be opened or closed in synchronization with opening or closing of the contact unit 1. The detector 5 is configured to detect an opened or closed state of the contact unit 1 based on an opened or closed state of the auxiliary contacts 50. In the embodiment, a detection result on the opened or closed state of the contact unit 1 is supplied to the malfunction determination unit 6 as a DC voltage signal (hereinafter called a "contact detecting signal") of which level is high in the closed (ON) state and low in the opened (OFF) state.

Figure 4:
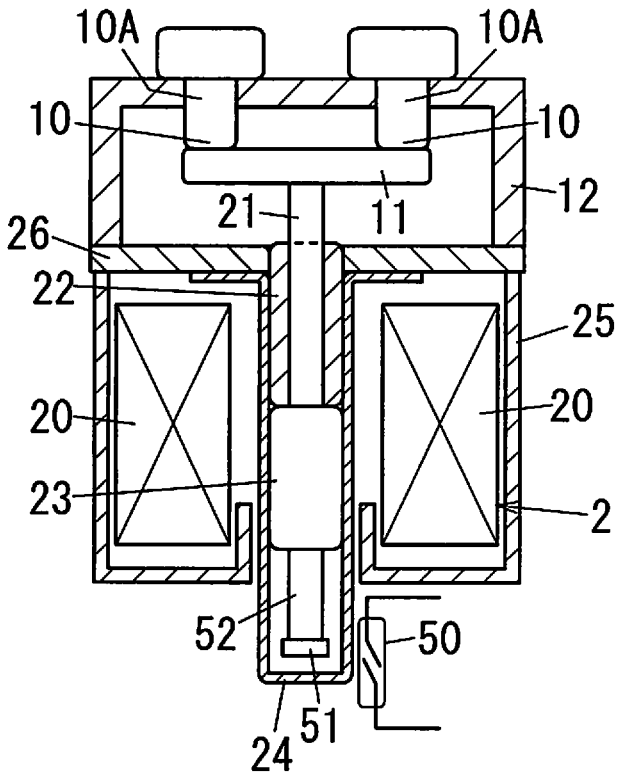
FIG. 4 is a sectional view of another example of the electromagnetic opening/closing device.

As shown in FIG. 2, the auxiliary contacts 50 is included in a reed switch disposed outside the bottom of the cap 24, and is configured to be turned on by magnetic force of a permanent magnet 51 attached to an end face (in FIG. 2, a bottom face) of the movable core 23. That is, when the contact unit 1 is opened, the movable core 23 is positioned on the bottom side (the lower side) of the cap 24, so that the reed switch (the auxiliary contacts 50) is turned on by the magnetic force of the permanent magnet 51. When the contact unit 1 is closed, the movable core 23 is positioned on the opening side (the upper side) of the cap 24, so that the reed switch (the auxiliary contacts 50) is little affected by the magnetic force from the permanent magnet 51 to be turned off. As another example, the auxiliary contacts 50 may be placed at the lateral face of the cap 24 as shown in FIG. 4. In this example, the permanent magnet 51 is attached to a tip (a lower end) of a support member 52 provided on the bottom of the movable core 23.

The malfunction determination unit 6 is configured to determine the presence or absence of malfunction based on: an opened or closed state of the stationary contacts 10 and the moving contact 11, detected through the detector 5; and an opened or closed state of the stationary contacts 10 and the moving contact 11, corresponding to an exterior command. In the embodiment, the malfunction determination unit 6 is configured: to compare a control signal (a close or open control signal) and a contact detecting signal; and then to determine the absence of malfunction (contact failure) when both signals are high level signals (closed states) or low level signals (opened states) and also to determine the presence of malfunction when one of the signals is a high level signal and the other is a low level signal. The determination result of the malfunction determination unit 6 is then supplied to the control unit 3. The control unit 3 allows the output unit 8 to output a high level signal as a detection signal when the determination result from the malfunction determination unit 6 represents the absence of malfunction, and also to output a low level signal as a (malfunction) detection signal when the determination result represents the presence of malfunction. The control unit 3, the input unit 4, the malfunction determination unit 6, the storage unit 7 and the output unit 8 may be each formed of their own individual hardware (circuits), or formed of one microcomputer and various software.

A certain time is required for a period of time from a point in time when a control signal is input to the input unit 4 to a point in time when the drive unit 2 drives the contact unit 1 and an opened or closed state of the contact unit 1 is switched. In an electromagnetic relay (the electromagnetic opening/closing device), typically the time required to close contacts is called an operating time, and the time required to open the contacts is called a recovery time. That is, an error may occur in the determination of the presence or absence of malfunction if the malfunction determination unit 6 compares the control signal and the contact detecting signal before the elapse of the operating time or the recovery time. It is therefore desirable that the malfunction determination unit 6 be prohibited from determining the presence or absence of malfunction during the operating time or the recovery time.

Figure 3A:
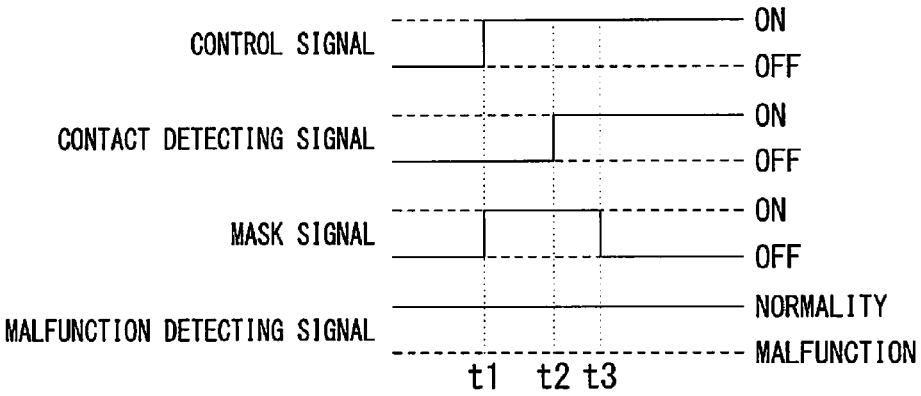
FIGS. 3A to 3C are time charts showing determination processes by a malfunction determination unit in the electromagnetic opening/closing device.
Figure 3B:
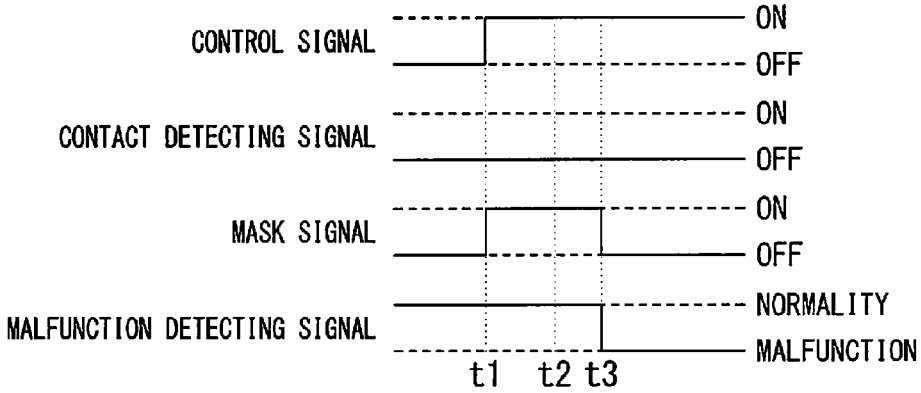
Figure 3C:
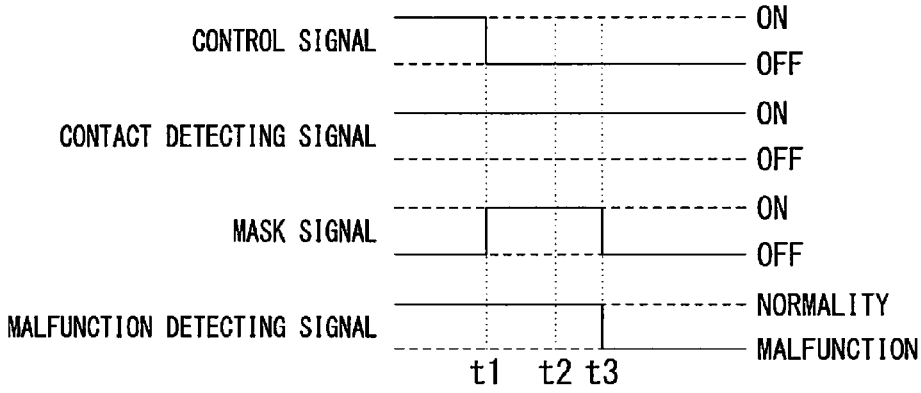
Figure 5:
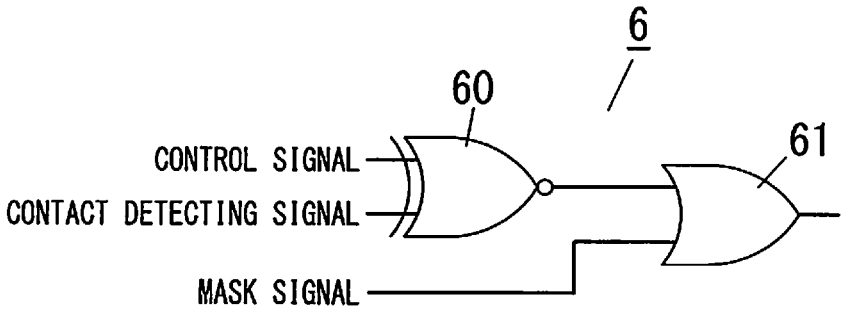
FIG. 5 is a circuit diagram of the malfunction determination unit in the electromagnetic opening/closing device of the embodiment 1.

Therefore, the malfunction determination unit 6 in the embodiment is formed of an exclusive OR circuit 60 and an OR circuit 61 as shown in FIG. 5, and the determination process of the presence or absence of malfunction is set to be ON (disabled) or OFF (enabled) by a mask signal (see FIGS. 3A to 3C). The exclusive OR circuit 60 inverts (NOT) the exclusive OR of the control signal and the contact detecting signal to output a signal. The OR circuit 61 outputs a logical sum of the signal output from the exclusive OR circuit 60 and the mask signal. The mask signal is a signal output from the control unit 3. That is, the mask signal is a DC voltage signal of which level becomes high only during a mask time, longer than the operating time or the recovery time, from a point in time when the control unit 3 switches high or low of the control signal to be supplied to the malfunction determination unit 6, and disables the determination process of the presence or absence of malfunction. For purpose of convenience, the output of the OR circuit 61 (the determination result by the malfunction determination unit 6) is called a malfunction detecting signal.

The determination process by the malfunction determination unit 6 is explained in detail with reference to FIGS. 3A to 3C. For example, when a control signal input from the control unit 3 to the malfunction determination unit 6 goes high at time t1, a mask signal input from the control unit 3 to the OR circuit 61 also goes high at the same time. The control unit 3 then supplies an excitation current to the excitation coil 20 of the drive unit 2. If there is no malfunction, the contact unit 1 is closed while a contact detecting signal of the detector 5 goes high, at time t2 (see FIG. 3A). On the other hand, if any malfunction is present, the contact unit 1 is not closed. Accordingly, the contact detecting signal of the detector 5 does not go high even though it passed time t2 (see FIG. 3B). Examples of such malfunction include: a foreign body having electrical insulation intervening between the stationary contacts 10 and the moving contact 11; the contact unit 1 being frozen; the movement of the moving contact 11 being obstructed due to some causes; and the like.

However, at time t2, the mask signal is a high level (ON) signal, and accordingly the output of the OR circuit 61, namely the malfunction detecting signal is kept high (normality) even if logical values of the control signal and the contact detecting signal are different from each other (see FIG. 3B).

When the mask signal goes low at time t3, the malfunction detecting signal is kept high if the logical values of the control signal and the contact detecting signal coincide with high level (see FIG. 3A). If the logical values are different from each other such that the control signal is a high level signal and the contact detecting signal is a low level signal, the malfunction detecting signal goes low (see FIG. 3B).

Alternatively, as shown in FIG. 3C, if the control signal input from the control unit 3 to the malfunction determination unit 6 goes low at time t1, the mask signal input from the control unit 3 to the OR circuit 61 goes high at the same time. The control unit 3 then stops supplying the excitation current to the excitation coil 20 of the drive unit 2. If there is no malfunction, the contact unit 1 is opened at time t2 and the contact detecting signal of the detector 5 goes low. On the other hand, if there is malfunction such as welding, the contact unit 1 is not opened and accordingly the contact detecting signal of the detector 5 does not go low even though it passed time t2. However, since the mask signal is the high level signal at time t2, the output of the OR circuit 61, namely the malfunction detecting signal is kept high (normality) even if the logical values of the control signal and the contact detecting signal are different from each other.

When the mask signal goes low at time t3, the malfunction detecting signal is kept high if the logical values of the control signal and the contact detecting signal coincide with low level. On the other hand, if the logical values are different from each other such that the control signal is a low level signal and the contact detecting signal is a high level signal, the malfunction detecting signal goes low (see FIG. 3C).

As mentioned above, the electromagnetic opening/closing device A1 in the present embodiment includes: the detector 5 configured to detect an opened or closed state of the contact unit 1; the malfunction determination unit 6 configured to determine the presence or absence of malfunction based on an opened or closed state of the contact unit 1 detected through the detector 5 and an opened or closed state of the contact unit 1 corresponding to an exterior command; and the output unit 8 configured to supply an exterior with a determination result by the malfunction determination unit 6. The electromagnetic opening/closing device A1 can therefore perform self-checking on the presence or absence of malfunction to give a notification to the exterior. As a result, it is possible to easily monitor the malfunction (failure) of the electromagnetic opening/closing device A1 without detecting the malfunction of the contact unit 1 through an apparatus (an external apparatus 200) equipped with the electromagnetic opening/closing device A1 like conventional apparatuses.

Figure 6:
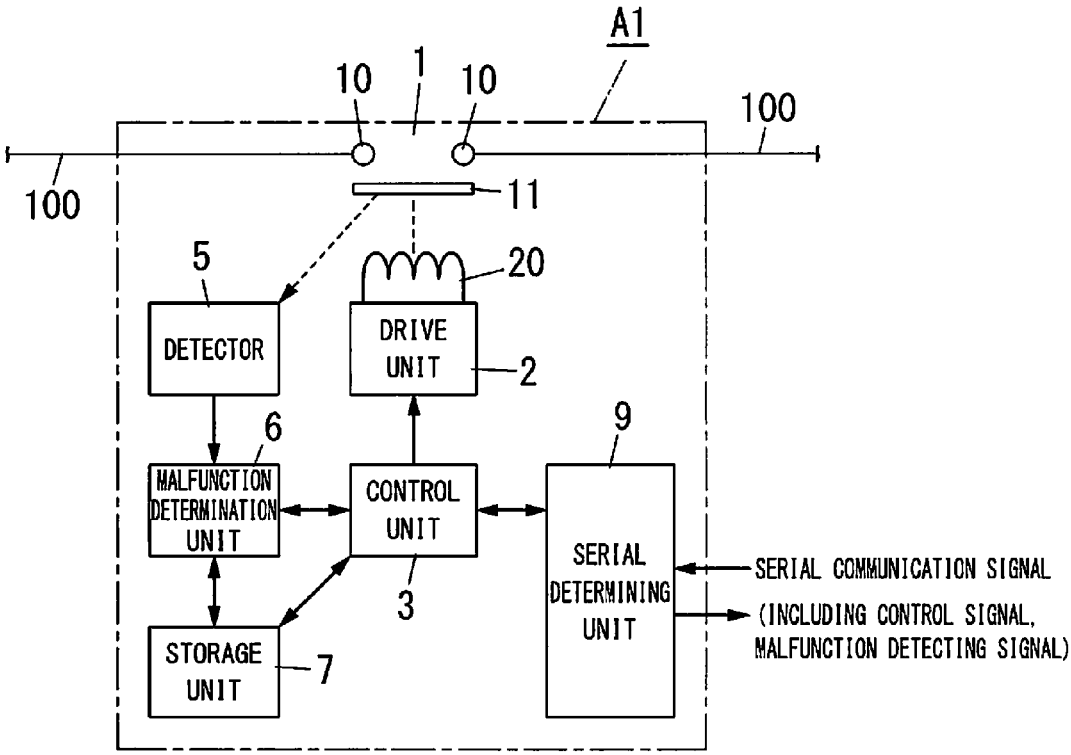
FIG. 6 is a block diagram of a modified embodiment.
Figure 7:
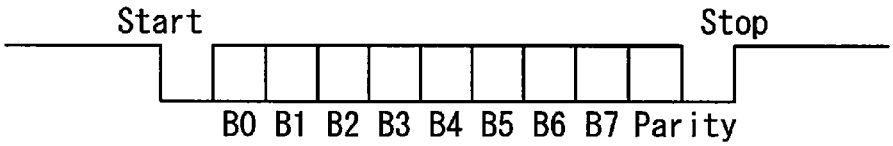
FIG. 7 is an explanatory diagram of a malfunction detecting signal in FIG. 6.

In a modified embodiment, the electromagnetic opening/closing device A1 is provided with a serial communication unit 9 configured to interface the control unit 3 with an external communication as shown in FIG. 6 in place of the input unit 4 and the output unit 8. In this embodiment, multi-bit information can be applied to an exterior as shown in FIG. 7. It is accordingly possible to not only determine the presence or absence of malfunction (failure) but also specify a type of the malfunction through the external apparatus by assigning different bits per occurring malfunction type (closing malfunction such as contact failure or conduct failure; opening malfunction such as contact welding or cutoff failure; or the like). For example, a first bit (B0) may be set to one when occurring malfunction is estimated to be contact failure caused by a foreign body or the like, and a second bit (B1) may be set to one when occurring malfunction is estimated to be contact welding.

Figure 8A:
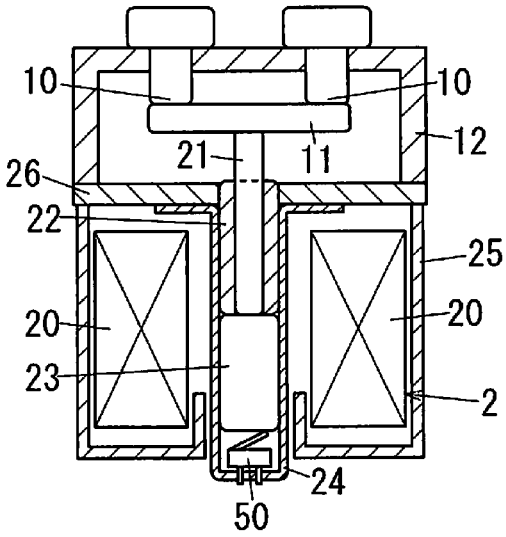
FIGS. 8A to 8C are sectional views of examples of auxiliary contacts in the electromagnetic opening/closing device of the embodiment 1.
Figure 8B:
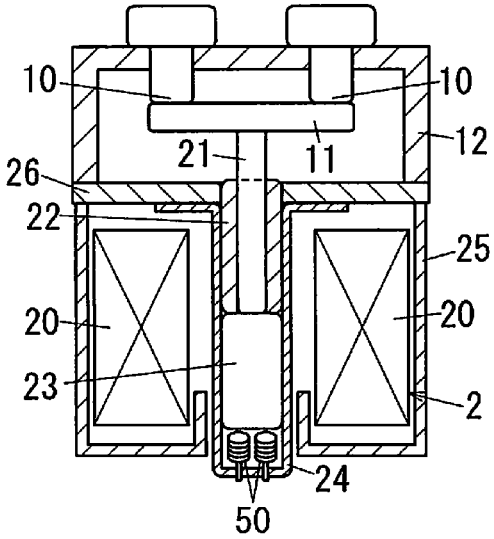
Figure 8C:
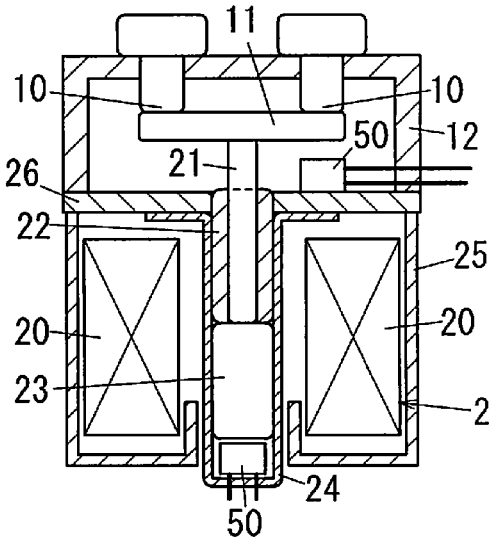

The auxiliary contacts 50 are not limited to the reed switch. In an example, as shown in FIG. 8A, the auxiliary contacts 50 are included in a micro switch placed on an inner bottom of the cap 24. In this example, the movable core 23 turns on the micro switch (auxiliary contacts 50) when the contact unit 1 is opened, and turns off the micro switch (auxiliary contacts 50) when the contact unit 1 is closed. In another example, as shown in FIG. 8B, the auxiliary contacts 50 are included in a pair of spring contacts arranged side by side on the inner bottom of the cap 24. In this example, the pair of spring contacts (auxiliary contacts 50) is turned on through the movable core 23 when the contact unit 1 is opened, and the pair of spring contacts (auxiliary contacts 50) is turned off through the movable core 23 when the contact unit 1 is closed. In other example, as shown in FIG. 8C, the auxiliary contacts 50 include a contact placed on the inner bottom of the cap 24 and a contact placed on an upper face of the yoke 26. In this example, the auxiliary contacts 50 are turned on when the contact unit 1 is opened, because a closed circuit. is formed between the two contacts through the yoke 26, the stationary core 22 and the movable core 23. On the other hand, the auxiliary contacts 50 are turned off when the contact unit 1 is closed, because the closed circuit. is not formed.

Embodiment 2

An electromagnetic opening/closing device A2 in the present embodiment has the same fundamental construction as embodiment 1, hence like kind elements are assigned the same reference numerals as depicted in embodiment 1, and illustrations and description of the configuration are omitted.

Figure 9A:
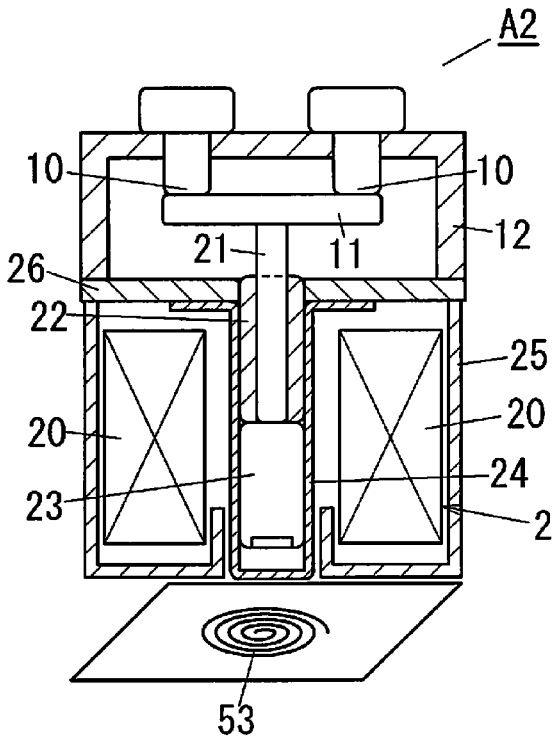
FIGS. 9A and 9B are sectional views of an electromagnetic opening/closing device in accordance with an embodiment 2 of the present invention.
Figure 9B:
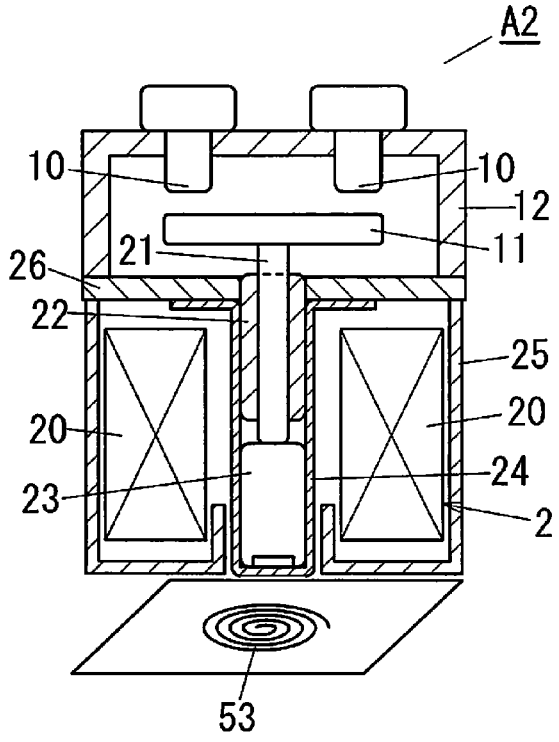

As shown in FIGS. 9A and 9B, a detector 5 in the present embodiment includes a detection coil 53 placed at a position facing an end face (a lower end) of a cap 24, and is configured to detect an opened or closed state of a contact unit 1 by a characteristic, of an electric circuit including the detection coil 53, varying in response to a distance between the coil and a movable core 23.

The detector 5 has, for example, an LC oscillator circuit formed of a parallel circuit of the detection coil 53 and a capacitor (not shown). When the movable core 23 made of metal approaches the detection coil 53 of the LC oscillator circuit, an eddy-current loss caused by electromagnetic induction occurs, thereby changing an effective resistance value (conductance) of the detection coil 53. If the conductance of the detection coil 53 changes, an oscillation condition of the LC oscillator circuit changes as well. Accordingly, from an oscillation state of the LC oscillator circuit, the oscillation of the oscillator circuit is stopped, or the oscillation amplitude is attenuated by a prescribed value or more. The detector 5 can therefore determine that the movable core 23 is approaching the coil, or the contact unit 1 is opened as a result of the cessation of oscillation of the LC oscillator circuit or the attenuation of the prescribed value or more in oscillation amplitude (see FIG. 9B). The detector 5 can also determine that the movable core 23 is apart from the coil, namely the contact unit 1 is closed as a result of the start of oscillation of the LC oscillator circuit or the increase of the prescribed value or more in oscillation amplitude (see FIG. 9A). In short, the detector 5 can detect an opened or closed state of the contact unit 1 based on the characteristic of the electric circuit (the LC oscillator circuit) including the detection coil 53 (the presence or absence of oscillation or a magnitude of oscillation amplitude).

Figure 10:
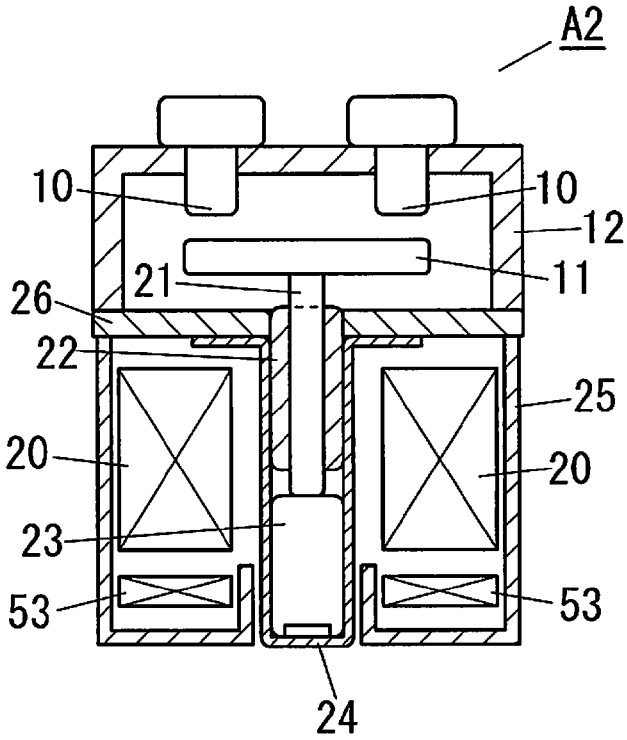
FIG. 10 is a sectional view of a modified embodiment.

In a modified embodiment, as shown in FIG. 10, the detection coil 53 is placed, not on a second side of a first direction with respect to the end face of the movable core 23 (not on a lower position than the end face of the movable core 23) but around the movable core 23 (at a lower side of an excitation coil 20 in the figure). In another example, a high frequency electric current is superposed on an excitation current through the excitation coil 20, and consequently the excitation coil 20 is also employed as the detection coil.

In the aforementioned detection method, the high frequency electric current needs to be continuously supplied to the detection coil 53 of the detector 5, thereby increasing power consumption in the detector 5. In order to suppress the increase of the power consumption in the detector 5, desirably the following detection method is adapted to the example.

The time constant of the LC oscillator circuit is in proportion to the conductance of the detection coil 53, and accordingly the detection method utilizes the time constant which increases as the conductance increases. For example, when a constant voltage is applied across the detection coil 53, a rise time of a voltage V across the detection coil 53 becomes slower as the LC oscillator circuit has a larger time constant.

Figure 11:
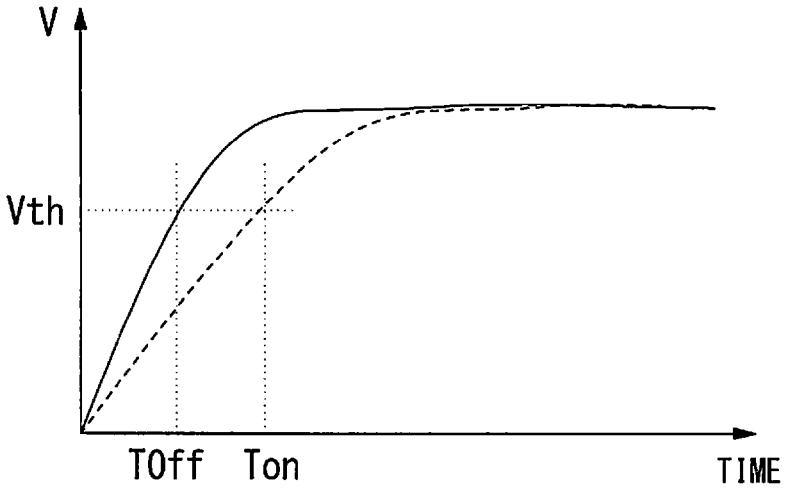
FIG. 11 is an explanatory diagram of an operation of a detector in FIG. 10.

The detector 5 can determine opening or closing of the contact unit 1 to detect an opened or closed state thereof, by periodically applying a pulse voltage across the detection coil 53 while detecting a rise time Ton, Toff during which the voltage V across the detection coil 53 exceeds a predetermined reference value Vth (see FIG. 11). In this method, by applying the pulse voltage (or a step voltage) across the detection coil 53, it is possible to suppress the increase of power consumption in the detector 5 in comparison with the case where a high frequency electric current is continuously supplied to the detection coil 53.

Embodiment 3

An electromagnetic opening/closing device A3 in the present embodiment has the same fundamental construction as embodiment 1, hence like kind elements are assigned the same reference numerals as depicted in embodiment 1, and illustrations and description of the configuration are omitted.

Figure 12A:
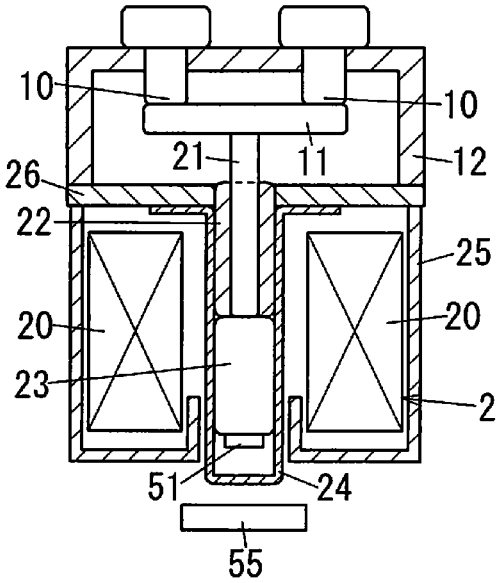
FIGS. 12A to 12C are sectional views of examples of a detector 5 in an electromagnetic opening/closing device in accordance with an embodiment 3 of the present invention.
Figure 12B:
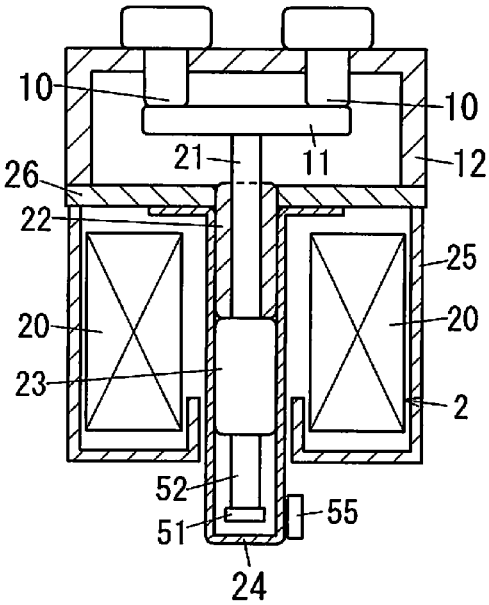
Figure 12C:
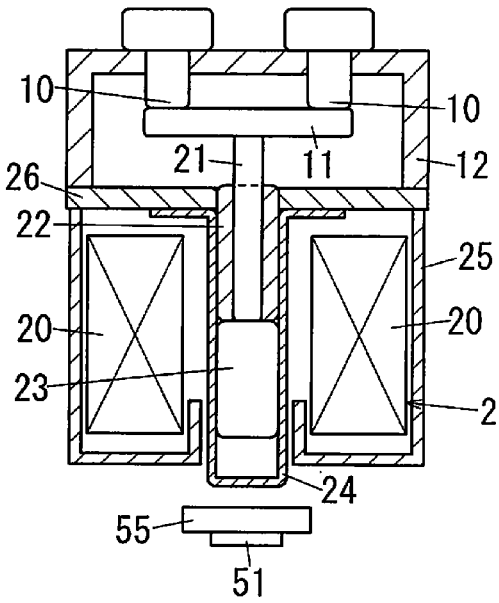

A detector 5 in the present embodiment is configured to detect a movement of a movable core 23 through a magnetic sensor 55 with a Hall effect sensor. For example, as shown in FIG. 12 A, the magnetic sensor 55 is placed at a second side of a first direction with respect to an end face of a cap 24 (at a lower position than the end face of the cap 24), and detects a position of a permanent magnet 51 attached on an end face (a lower face) of the movable core 23. In another example, the magnetic sensor 55 is placed at a lateral side of the cap 24 as shown in FIG. 12B. In this example, the permanent magnet 51 is attached on a tip end (a lower end) of a support member 52 placed on a bottom of the movable core 23. In an example, as shown in FIG. 12C, the magnetic sensor 55 has a first surface and a second surface and is disposed on the second side of the first direction with respect to the end face of the cap 24 (at a lower position than the end face of the cap 24) so that the first surface of the magnetic sensor 55 faces the end face of the cap 24. The permanent magnet 51 is attached on the second surface (a lower surface) of the magnetic sensor 55.

Embodiment 4

An electromagnetic opening/closing device A4 in the present embodiment has the same fundamental construction as embodiment 1, hence like kind elements are assigned the same reference numerals as depicted in embodiment 1, and illustrations and description of the configuration are omitted.

Figure 13:
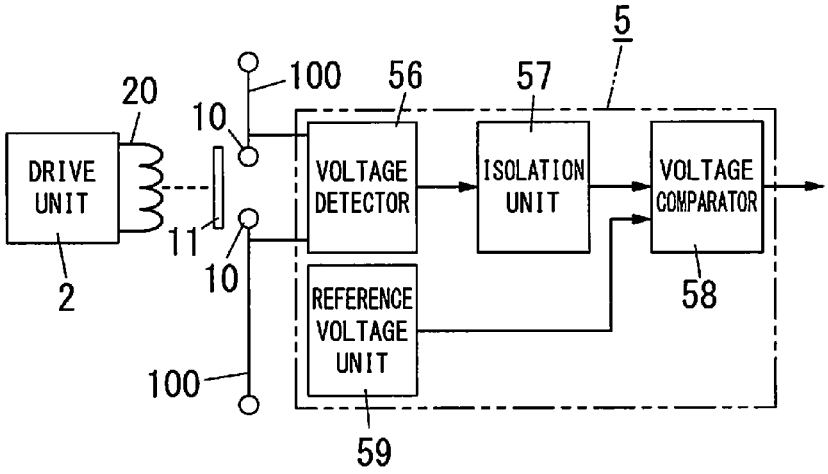
FIG. 13 is a block diagram of a detector in an electromagnetic opening/closing device in accordance with an embodiment 4 of the present invention.

In the present embodiment, a detector 5 is configured to detect an opened or closed state of a contact unit 1 based on a voltage applied across the contact unit 1 (hereinafter called a "contact voltage"). As shown in FIG. 13, the detector 5 has a voltage detector 56, an isolation unit 57, a voltage comparator 58, a reference voltage unit 59 and the like.

Figure 14:
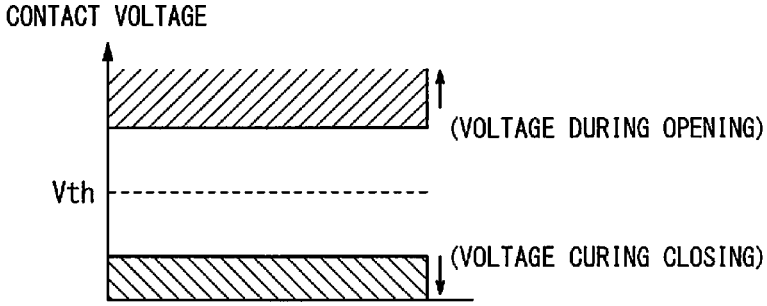
FIG. 14 is an explanatory diagram of an operation of a detector in embodiment 4.

The voltage detector 56 has a detection resistor (not shown) connected between a pair of stationary contacts 10, and is configured to detect the contact voltage by a voltage drop generated across the detection resistor. The isolation unit 57 is formed of a photo coupler and the like, and a detection result (the contact voltage) of the voltage detector 56 is supplied to the voltage comparator 58 via the isolation unit. An absolute value of the contact voltage is a relatively high voltage value V1 when the contact unit 1 is opened, while the absolute value of the contact voltage is a relatively low voltage (a voltage value approximating to zero) V0 when the contact unit 1 is closed (see FIG. 14). Accordingly, the voltage comparator 58 compares a detection result of the voltage detector 56 (the absolute value of the contact voltage) and a reference voltage Vth obtained from the reference voltage unit 59. The comparator then outputs a high level of contact detecting signal if the absolute value of the contact voltage is less than the reference voltage Vth, and also outputs a low level of contact detecting signal if the absolute value is equal to or more than the reference voltage Vth.

In the embodiment, the resistor for detecting the contact voltage consumes little power, and it is accordingly possible to suppress the increase of power consumption in the detector 5 in comparison with embodiment 2 in which the high frequency electric current is supplied to the detection coil 53.

When the contact voltage is detected through the detection resistor, a leakage current may flow from an electrical circuit 100 to the detection resistor. In order to avoid the occurrence of such a leakage current, it is preferable that the detector 5 detect the contact voltage of the contact unit 1 in a non-contact fashion. For example, a magnetic field generated around the contact unit 1 may be detected with a Hall effect sensor when an electric current flows through the electrical circuit 100 via the contact unit 1. That is, it is possible to indirectly detect the contact voltage based on intensity of the magnetic field, because the intensity of the magnetic field generated around the contact unit 1 is in proportion to the amount of the electric current flowing through the electrical circuit, and the amount of the electric current is in proportion to the contact voltage supposing the contact resistance of the contact unit 1 is constant.

Although the present invention has been described with reference to certain preferred embodiments, numerous modifications and variations can be made by those skilled in the art without departing from the true spirit and scope of this invention, namely claims.

The invention claimed is:

1. An electromagnetic opening/closing device, comprising a stationary contact and a moving contact, said electromagnetic opening/closing device being configured to open or close the stationary contact and the moving contact in accordance with an exterior command for opening or closing the stationary contact and the moving contact, wherein the electromagnetic opening/closing device comprises:

a detector configured to detect an opened or closed state of the stationary contact and the moving contact;

a determination unit configured to determine presence or absence of malfunction based on a comparison between the opened or closed state of the stationary contact and the moving contact detected through the detector and an opened or closed state of the stationary contact and the moving contact corresponding to the exterior command; and an output unit configured to supply a signal representing a determination result determined by the determination unit to an external apparatus outside the electromagnetic opening/closing device.

2. The electromagnetic opening/closing device of claim 1, wherein the determination unit is configured to determine that closing malfunction occurs between the stationary contact and the moving contact if a state of the stationary contact and the moving contact detected through the detector is the opened state when the exterior command is a close control signal for closing the stationary contact and the moving contact.

3. The electromagnetic opening/closing device of claim 2, wherein the determination unit is configured to determine that opening malfunction occurs between the stationary contact and the moving contact if a state of the stationary contact and the moving contact detected through the detector is the closed state when the exterior command is an open control signal for opening the stationary contact and the moving contact.

4. The electromagnetic opening/closing device of claim 3, wherein the output unit is configured to output a signal as the determination result indicating a type of the malfunction.

5. The electromagnetic opening/closing device of claim 2, wherein the output unit is configured to output a signal as the determination result indicating a type of the malfunction.

6. The electromagnetic opening/closing device of claim 1, wherein the determination unit is configured to determine that opening malfunction occurs between the stationary contact and the moving contact if a state of the stationary contact and the moving contact detected through the detector is the closed state when the exterior command is an open control signal for opening the stationary contact and the moving contact.

7. The electromagnetic opening/closing device of claim 6, wherein the output unit is configured to output a signal as the determination result indicating a type of the malfunction.

8. The electromagnetic opening/closing device of claim 1, wherein the output unit is configured to output a signal as the determination result indicating a type of the malfunction.

9. The electromagnetic opening/closing device of claim 1, further comprising auxiliary contacts linked with opening or closing of the stationary contact and the moving contact, wherein the detector is configured to detect the opened or closed state of the stationary contact and the moving contact based on an opened or closed state of the auxiliary contacts.

10. The electromagnetic opening/closing device of claim 1, further comprising an electromagnet configured to allow the moving contact to come into contact with or separate from the stationary contact by electromagnetic force, wherein the detector comprises a detection coil configured to have impedance varying in response to excitation of the electromagnet, and is configured to detect opening or closing of the stationary contact and the moving contact based on a change in the impedance of the detection coil.

11. The electromagnetic opening/closing device of claim 1, comprising a drive unit configured to move the moving contact, wherein the detector is configured to detect the opened or closed state of the stationary contact and the moving contact based on a movement of the moving contact through the drive unit.

12. The electromagnetic opening/closing device of claim 3, wherein the detector is configured to detect the opened or closed state of the stationary contact and the moving contact based on a voltage applied across the stationary contact and the moving contact.

13. The electromagnetic opening/closing device of claim 1, wherein the signal is a level signal or a signal containing multi-bit information.

* * * * *